US009016004B2

(12) United States Patent
Vogt

(10) Patent No.: US 9,016,004 B2
(45) Date of Patent: Apr. 28, 2015

(54) APPARATUS FOR AND METHOD OF FOLDING A MAST OR DERRICK

(71) Applicant: Woolslayer Companies, Inc., Tulsa, OK (US)

(72) Inventor: Dewayne G. Vogt, Tulsa, OK (US)

(73) Assignee: Woolslayer Companies, Inc., Tulsa, OK (US)

( * ) Notice: Subject to any disclaimer, the term of this patent is extended or adjusted under 35 U.S.C. 154(b) by 0 days.

(21) Appl. No.: 13/839,089

(22) Filed: Mar. 15, 2013

(65) Prior Publication Data

US 2014/0298735 A1 Oct. 9, 2014

(51) Int. Cl.

| | |
|---|---|
| ***E21B 15/00*** | (2006.01) |
| ***E21B 7/02*** | (2006.01) |
| *E04H 12/18* | (2006.01) |

(52) U.S. Cl.

CPC ..... *E04H 12/18* (2013.01); *E21B 7/023* (2013.01)

(58) Field of Classification Search

CPC ..... E21B 15/00; E21B 7/023; E04H 12/182
USPC ..... 52/116, 117, 118, 119, 120, 121, 122.1, 52/123.1, 632, 648.1, 651.01, 651.02, 52/651.03, 651.05, 651.06, 651.07, 52/651.08, 651.09, 653.1, 745.03, 745.04, 52/745.17, 745.18; 175/162; 212/175, 212/176, 177, 296, 297, 298; 254/93 R, 254/89 H, 102; 414/22.51, 22.52, 22.53, 414/22.54, 22.55, 22.56, 22.57, 22.58, 414/22.59, 22.6, 22.61; 29/434

See application file for complete search history.

(56) References Cited

U.S. PATENT DOCUMENTS

| | | | | | |
|---|---|---|---|---|---|
| 2,176,965 | A | * | 10/1939 | Haynes | 52/121 |
| 3,835,612 | A | * | 9/1974 | Beziat | 52/638 |
| 3,942,593 | A | | 3/1976 | Reeve, Jr. et al. | |
| 4,290,495 | A | * | 9/1981 | Elliston | 175/85 |
| 4,579,302 | A | * | 4/1986 | Schneider et al. | 244/159.4 |
| 4,604,844 | A | * | 8/1986 | Mikulas et al. | 52/632 |
| 4,651,884 | A | | 3/1987 | Kennard, Jr. et al. | |
| 5,211,251 | A | * | 5/1993 | Woolslayer | 175/85 |
| 5,450,695 | A | | 9/1995 | Desai | |
| 5,540,540 | A | * | 7/1996 | Peterson | 414/563 |
| 5,628,265 | A | * | 5/1997 | Azima et al. | 114/39.21 |
| 5,709,522 | A | * | 1/1998 | Cullum | 414/563 |
| 5,845,451 | A | * | 12/1998 | Tolentino | 52/646 |
| 6,594,960 | B2 | * | 7/2003 | Brittain et al. | 52/117 |
| 8,112,946 | B2 | * | 2/2012 | Vogt | 52/116 |
| 2009/0107945 | A1 | * | 4/2009 | Ehrenleitner | 212/176 |
| 2013/0047544 | A1 | * | 2/2013 | Dayton | 52/634 |

FOREIGN PATENT DOCUMENTS

| | | | | | |
|---|---|---|---|---|---|
| GB | 2063959 | A | * | 6/1981 | E04B 1/19 |
| WO | WO 9315303 | A1 | * | 8/1993 | E21B 19/15 |

* cited by examiner

*Primary Examiner* — Charles A Fox
*Assistant Examiner* — Joseph J Sadlon
(74) *Attorney, Agent, or Firm* — Head, Johnson & Kachigian, P.C.

(57) ABSTRACT

A method of folding a mast or derrick and a folding mast apparatus having a back face and a pair of opposed sides with each of the opposed sides having a front leg and a back leg. The apparatus includes at least one spreader beam assembly extending across the back face and connecting the back legs of the pair of opposed sides. At least one pair of telescoping braces extends between the at least one spreader beam assembly and the back legs. A pair of mast folding cylinders, each of the cylinders extending between one back leg and the back face, moves the pair of opposed sides between an open, use position and a closed, transportation position.

19 Claims, 8 Drawing Sheets

APPARATUS FOR AND METHOD OF FOLDING A MAST OR DERRICK

BACKGROUND OF THE INVENTION

1. Field of the Invention

The present invention is directed to an apparatus for and a method of folding a mast or derrick. In particular, the present invention is directed to a folding mast or derrick that may be efficiently assembled and then disassembled and readily transported from one well site to another.

2. Related Art

Well drilling rigs in oil and gas operations are utilized to drill for reserves. Many times drilling does not result in a productive well and it has been estimated that over two million bore holes have been dug worldwide.

Masts or derricks are well known for use in oil and gas and other drilling operations. The mast or derrick may be mounted on a fixed platform or on a jackup platform above ground level over a well bore. A mast often extends up to two hundred feet above a drill floor and is often composed of structural steel framework which supports a crown assembly. A mast or derrick of a drilling rig supports a vertically moving block and tackle in order to raise and lower a series of drill pipes which support a drill bit.

One type of known portable derrick structure is disclosed in Kennard, Jr. (U.S. Pat. No. 4,651,884) which is mounted on a vehicle. The derrick is movable between horizontal and vertical positions.

One well known type of drilling structure includes a pair of sides with a back face joining the sides and an open front or V-door face. A mast is, accordingly, typically braced or cross braced on three sides with an open front face to receive and remove pipe sections and other equipment.

The mast or derrick itself may be composed of a lower or bottom mast section assembly connected to a drill floor and one or more upper mast section assemblies connected thereto on top of the lower mast section. In some configurations, the lower or bottom mast section is wider than the other mast sections.

As drilling is conducted, the drill bit becomes dull or broken and the whole drill string has to be taken out of the hole and the bit repaired or replaced. In addition, in some applications, casing, consisting of thick-walled pipes, are screwed together and lowered into the well.

From time to time, once a drilling project has been completed, it is required to move the drilling rig from one location to another location. In one known process, the entire drilling rig is disassembled piece by piece, then transported to the next location, and then reassembled piece by piece. This process is both labor intensive and time consuming.

As a technological advance on the complete disassembly and reassembly of the mast or derrick, a folding gin pole or A-pole arrangement was developed. The entire mast could be moved from vertical to horizontal position by a wire line extending from the crown assembly to a gin pole or A-pole at the base of the rig. Once in the horizontal position on the ground, the mast could thereafter be disassembled.

In many applications, the mast sections are transported by trailer. Disassembly of the mast sections is normally required due to roadway limits such as height and width.

It would be desirable to fit the various masts sections on to trailers for highway transportation with a minimum of disassembly.

Additionally, it would be advantageous for the mast sections to be able to meet roadway requirements for size of load. For example, certain highway regulations limit the width of the load to 12 or 14 feet. Accordingly, it would be advantageous to provide a mast or derrick wherein the mast sections may be reduced in size for transportation to a width acceptable for roadway requirements.

It would also be advantageous to provide a mast or derrick having sections that may be moved between an open, in-use position and a folded position for storage and transportation.

It would also be advantageous to provide a mast or derrick having sections that may be locked in either an open, in-use position or a folded position for storage and transportation.

It would also be advantageous to provide a mast or derrick that may be moved between an open in-use position and a folded position utilizing hydraulic cylinders.

It would also be advantageous to provide a mast or derrick wherein the required disassembly and subsequent re-assembly is reduced.

It would also be advantageous to provide a method of folding a mast wherein the block and tackle may be secured to a mast section during transportation and accordingly, disassembly is not required.

Assignee's prior patent (Brittain et al. U.S. Pat. No. 6,594,960) shows an example of articulating a back face of a mast or derrick using a crane and a forklift.

It would also be advantageous to provide a method of moving a mast or derrick between an open, in-use position and a folded position utilizing existing hydraulic systems on the drilling rig at the well site.

SUMMARY OF THE INVENTION

The present invention is directed to a folding mast and a method of folding and unfolding a mast.

The mast apparatus of the present invention includes a lower mast assembly and one or more upper mast assemblies mounted thereon. The lower mast assembly includes a pair of opposed sides with a back face joining the two opposed sides together. The lower mast assembly may be moved between a folded, closed, transportation position and an unfolded, open, use position.

At least one spreader beam assembly extends across the back face and connects the back legs of the pair of opposed sides.

Each spreader beam assembly includes a pair of inner members and a pair of outer channel members. Each inner member is pivotally connected to an outer channel member at a pivot shaft. When each spreader beam assembly is in the open, use position, the inner member is aligned with the outer channel member.

A pair of telescoping braces are provided for each spreader beam assembly. Each telescoping brace extends between its respective spreader beam assembly and one of the back legs.

A pair of mast folding cylinders are utilized and actuated to move the opposed sides between the open, use position and the closed, transportation position. The mast folding cylinders are each connected to the existing hydraulic system of the mast apparatus.

BRIEF DESCRIPTION OF THE DRAWINGS

FIG. 5 illustrates an enlarged portion of a lower mast section shown in FIG. 2 while

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
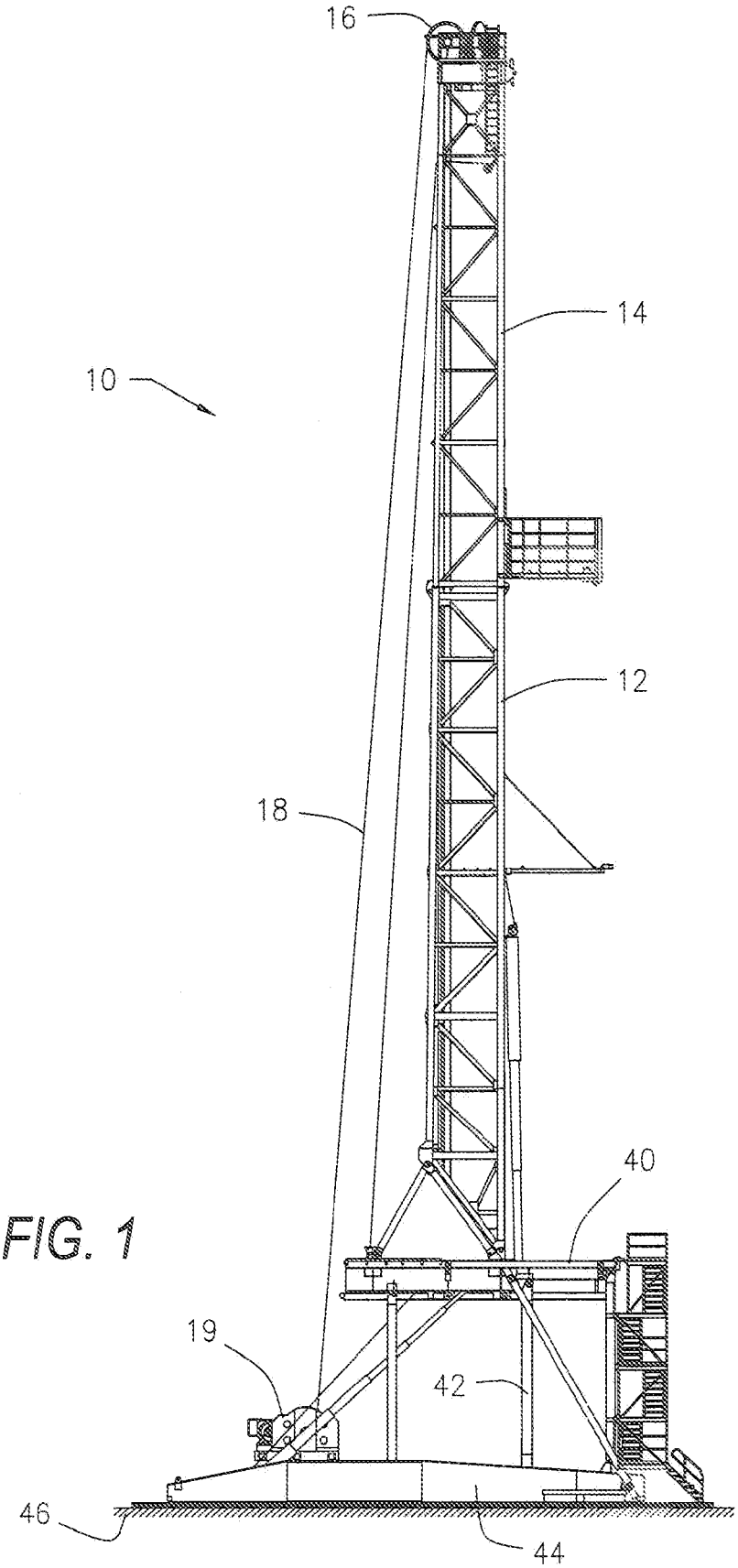
FIG. 1 illustrates a side view of an assembled, in-use mast apparatus constructed in accordance with the present invention.

Referring to the drawings in detail, FIG. 1 illustrates a side view of an assembled, in-use mast apparatus 10 having a lower mast assembly 12 and upper mast assembly 14 mounted thereon. A crown block 16 is mounted at the top of the upper mast assembly 14. The crown block 16 is connected by a wire line 18 to a draw works 19.

At the base of the lower mast section 12 is a drill floor 40, below which is a substructure 42 supported by a sub base 44 on ground 46.

The mast apparatus 10 includes a pair of opposed sides with the left side 62 visible in FIG. 1. The right side 64 would be substantially a mirror image of the left side. A back face joins the two opposed sides together. An open front or V-door face is opposed to the back face.

Figure 4:
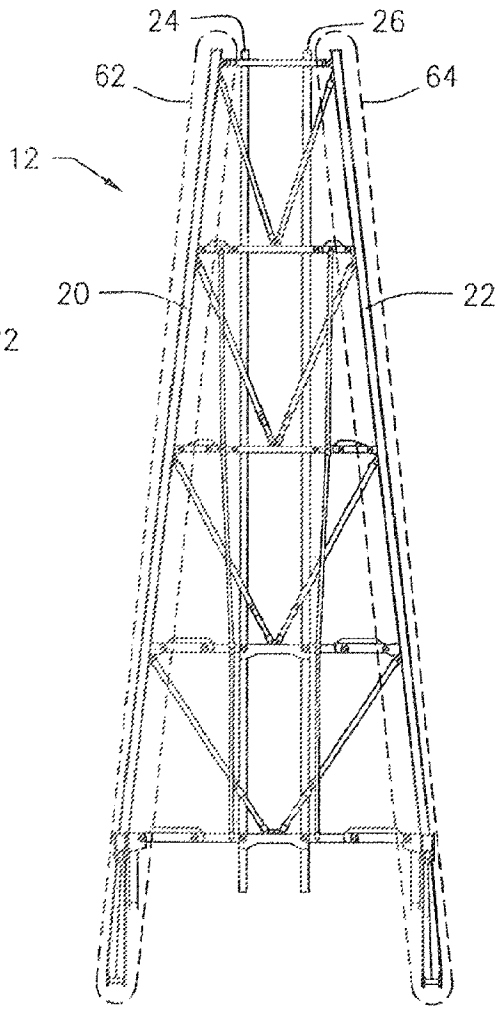
FIGS. 2, 3, and 4 illustrate alternate sequential positions in a method of folding and unfolding a mast in accordance with the present invention.
Figure 3:
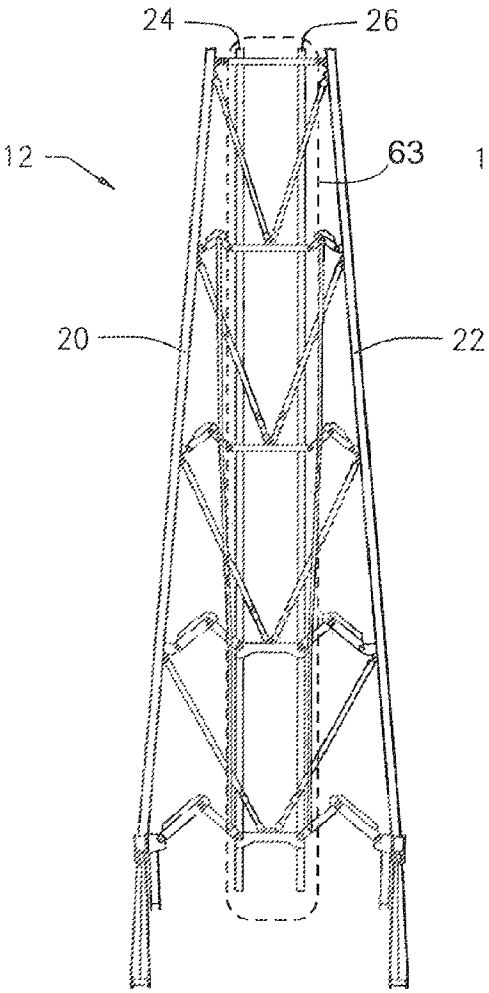
Figure 2:
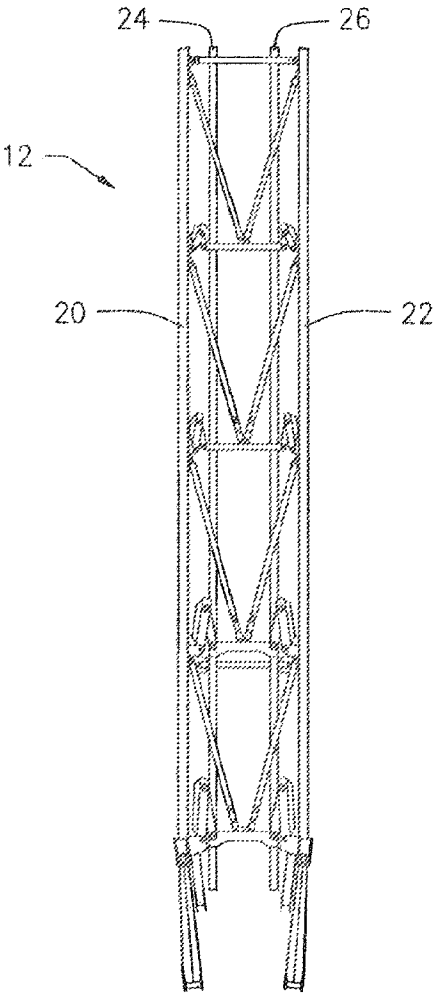

FIGS. 2, 3 and 4 illustrate alternate front views of the lower mast section 12 apart from the apparatus 10 and show sequential positions in the method of folding and unfolding a mast or derrick. FIG. 2 illustrates the lower mast assembly 12 in a folded, closed, transportation position. FIG. 4 illustrates the lower mast section assembly 12 in an open, use position while FIG. 3 illustrates the lower mast section assembly in an intermediate position. The base of the lower mast section assembly 12 would be connected when in use with a drill floor 40 and other structural supporting equipment. It will be appreciated that certain equipment has been removed from the drawings for clarity.

Figure 5:
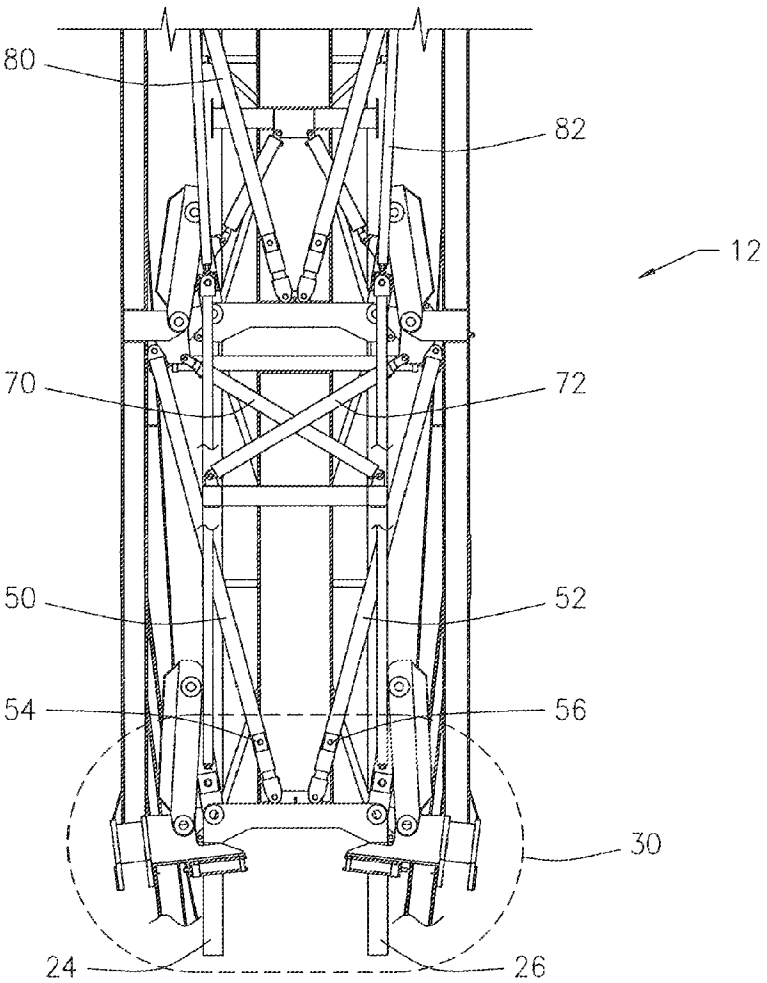
Figures 6, 7:
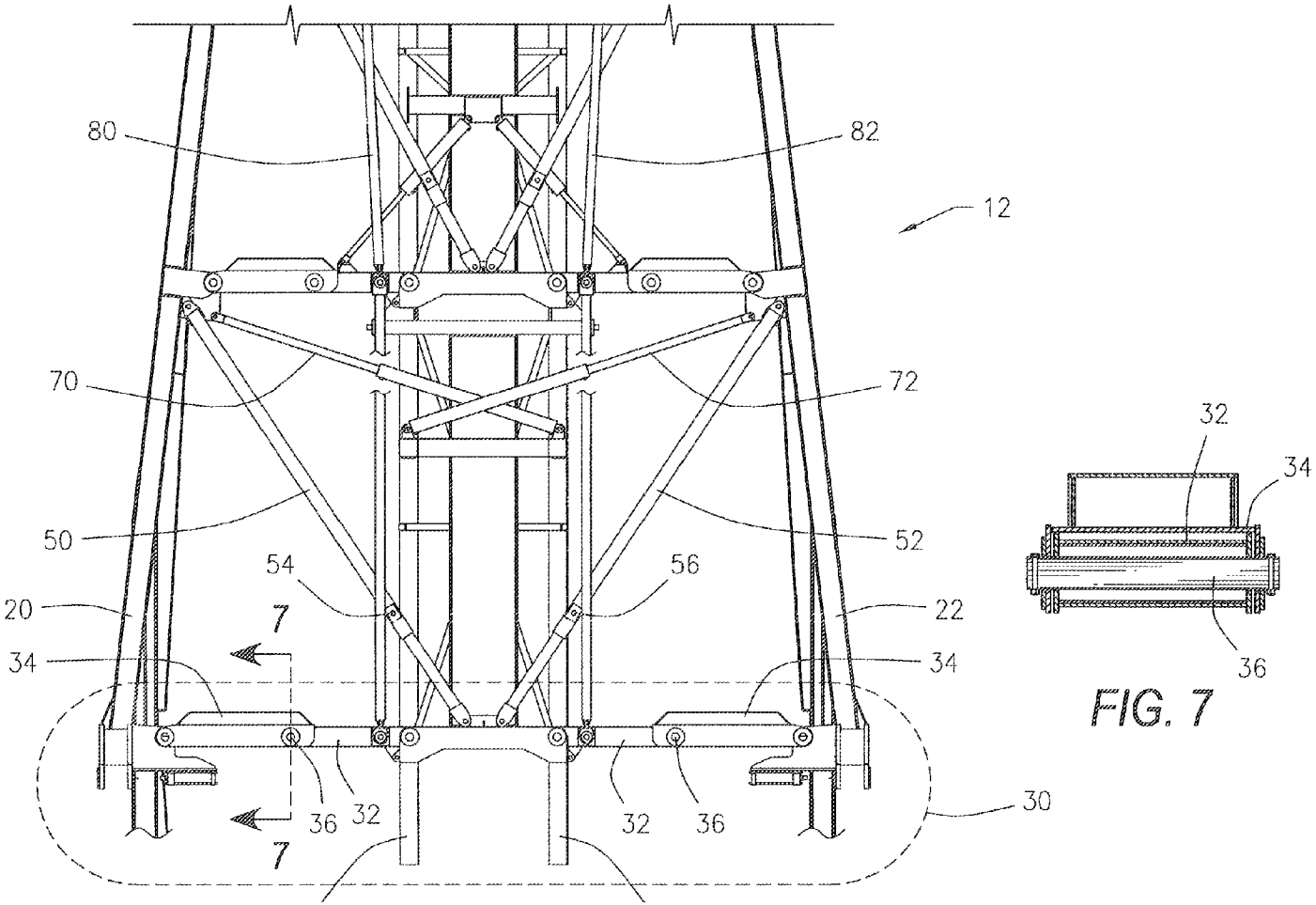
FIG. 6 illustrates an enlarged portion of the lower mast section shown in FIG. 4
FIG. 7 illustrates a sectional view as indicated in FIG. 6.

FIG. 5 illustrates an enlarged portion of the lower mast section 12 shown in FIG. 2 for ease of viewing. FIG. 6 illustrates an enlarged portion of the lower master section 12 shown on FIG. 4 for ease of viewing.

The mast apparatus 10 includes a back face 63 joining the sides 62 and 64 (See FIG. 4) and an open front or a V-door face. Each of the opposed sides includes a front leg 22 and a back leg (not visible on FIGS. 2, 3, and 4). In the open position, the opposed sides and back face, thus, form a truncated pyramid. In the closed position, the opposed sides are substantially parallel to each other.

The back face includes a pair of stationery guide tracks 24 and 26 which are used as guides for a traveling block (not shown).

At least one spreader beam assembly 30 extends across the back face and connects the back legs of the pair of the opposed sides 62 and 64. As seen in FIGS. 2, 3, and 4, the lower mast assembly 12 includes four spreader beam assemblies 30, two of which are visible in FIG. 5 and in FIG. 6. Each spreader beam assembly 30 is substantially parallel to the other spreader beam assemblies.

With continuing reference to FIGS. 5 and 6 and with reference to the sectional view shown in FIG. 7, each spreader beam assembly 30 includes a pair of inner members 32 and a pair of outer channel members 34. Each inner member 32 is pivotally connected to the outer channel member 34 at a pivot shaft 36. When each spreader beam assembly 30 is in the open, use position as shown in FIGS. 6 and 7, the inner member 32 is aligned with the outer channel member 34.

The outer channel member 34 is substantially C-shaped and is received over a portion of the inner member 32. Conversely, when each spreader beam assembly 30 is in the closed, transportation position as shown in FIG. 5, the inner member 32 is in angular relation to the outer channel member 34.

In the open use position, the closed transportation position or any position in between the pair of guide tracks 24 and 26 remain stationery.

A pair of telescoping braces 50 and 52 are provided for each spreader beam assembly 30. Each telescoping brace extends between its respective spreader beam assembly 30 and one of the back legs 20 or 22. In the present embodiment, the telescoping braces 50 and 52 include a pair of cylindrical tubes having an inner tube within an outer tube. In the open, use position shown in FIGS. 6 and 7, the telescoping braces 50 and 52 are in their extended position. Conversely, when in the closed, transportation position shown in FIG. 5, the telescoping braces 50 and 52 are retracted. The telescoping braces may be secured in either position through pins or bolts through aligned openings 54 and 56, respectively.

A pair of mast folding cylinders 70 and 72 are utilized and actuated to move the opposed sides 62 and 64 from the open, use position to the closed, transportation position. The mast folding cylinders 70 and 72 are each connected to the existing hydraulic system (not shown) of the mast apparatus. When the pair of mast folding cylinders 70 and 72 are actuated, the length of the cylinders 70 and 72 is reduced and the pair of opposed sides are brought toward each other to the closed, transportation position as seen in FIGS. 2 and 5.

The pair of mast folding cylinders 70 and 72 are also utilized and actuated to unfold the mast apparatus 10 to move the opposed sides 62 and 64 from the closed, transportation position to the open, use position. When the mast folding cylinders 70 and 72 are actuated, the length of the cylinders 70 and 72 is extended and the pair of sides 60 and 64 are moved away from each other to the open, use position as seen in FIGS. 4 and 6.

A series of optional folding braces 80 and 82 may be observed from FIGS. 2, 3, 4, 5 and 6. Each folding brace 80 and 82 is pivotally connected at one end to one of the inner members 32. An opposite end of each folding brace 80 and 82 is pivotally connected at an opposite end to another inner member 32. Accordingly, movement of one inner member 32 will encourage and force movement of the other inner members 32.

Figure 8:
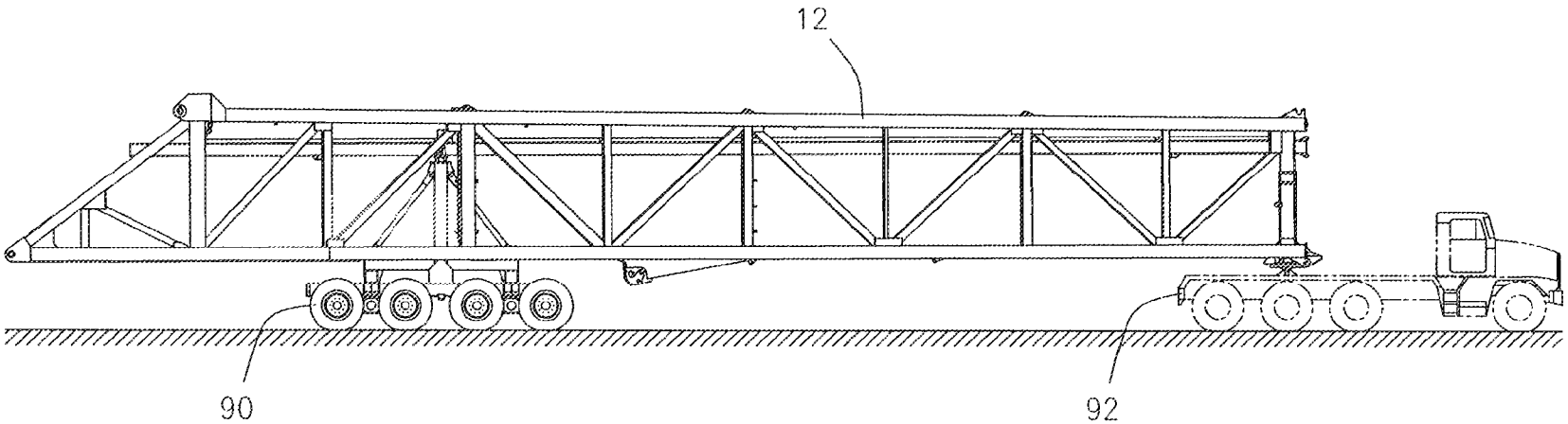
FIGS. 8 through 13 show a sequential installation of the mast apparatus utilizing the method of the present invention.

FIGS. 8 through 13 show the sequential installation of the mast apparatus 10. As seen in FIG. 8, the lower mast section 12 is in the closed, transportation position shown in FIGS. 2 and 5 loaded on a dolly 90 and a tractor trailer 92. The top drive and travelling block may remain pinned in place during transportation. Accordingly, the lower mast section 12 has a reduced width when in the closed, transportation position.

Figure 9:
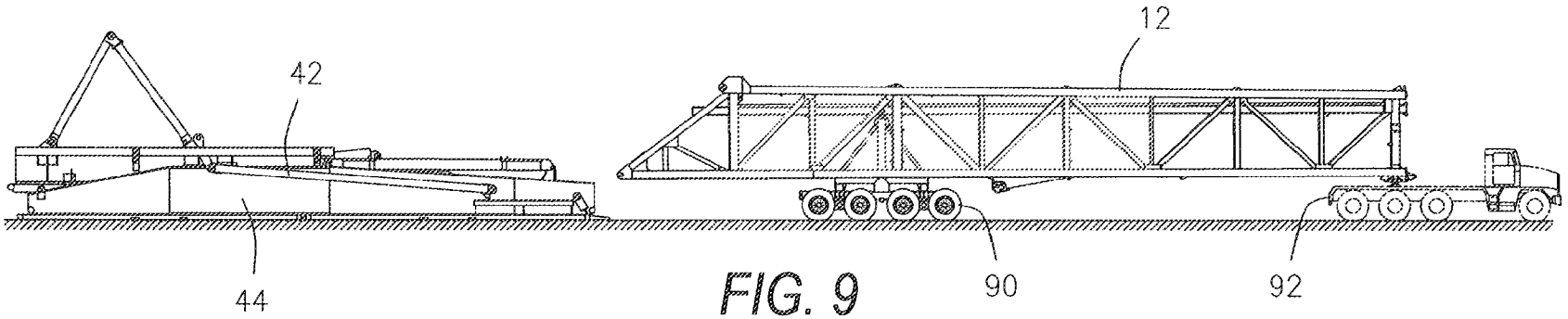

In order to install and assemble the mast apparatus 10 at a new site, FIGS. 8 through 13 show the sequential steps. The lower mast section 12 has been brought to a well site with the tractor trailer 92 moved in reverse to deliver the lower end of the lower mast section 12 to the substructure 42 and sub base 44 which are in the lowered position, as shown in FIG. 9. The lower mast section 12 is unfolded from the closed transportation position to the open, use position while on the dolly 90 utilizing the procedure previously described. Hydraulic power for the mast folding cylinders 70 and 72 is obtained at the site.

Figure 10:
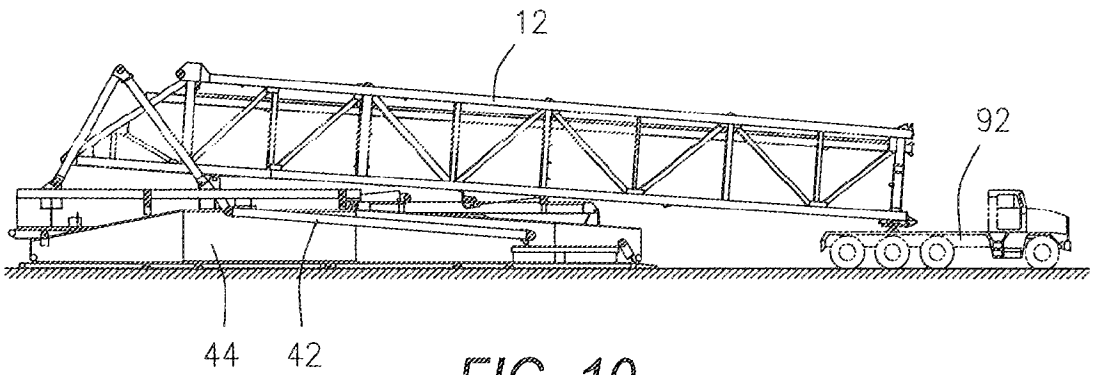

As best seen in FIG. 10, the dolly 90 is removed and the lower mast section 12 is moved on to the substructure 42.

Figure 11:
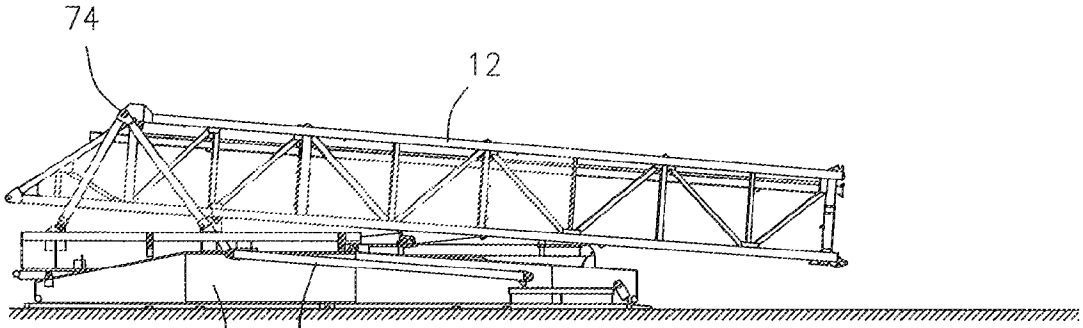

As best seen in FIG. 11, the lower mast assembly 12 is then brought into alignment with the gin pole 84 and connected by mast pivot pins 74.

Figure 12:
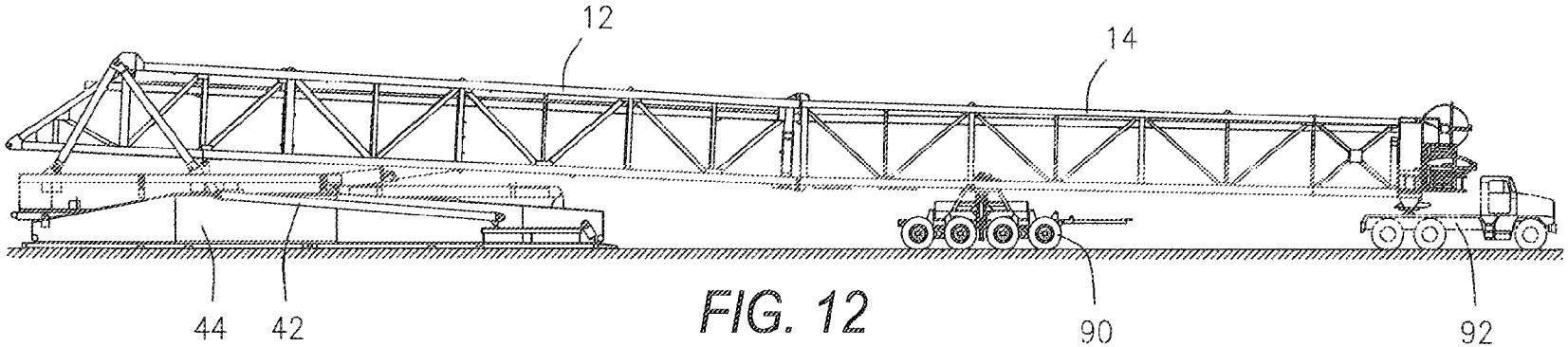
Figure 13:
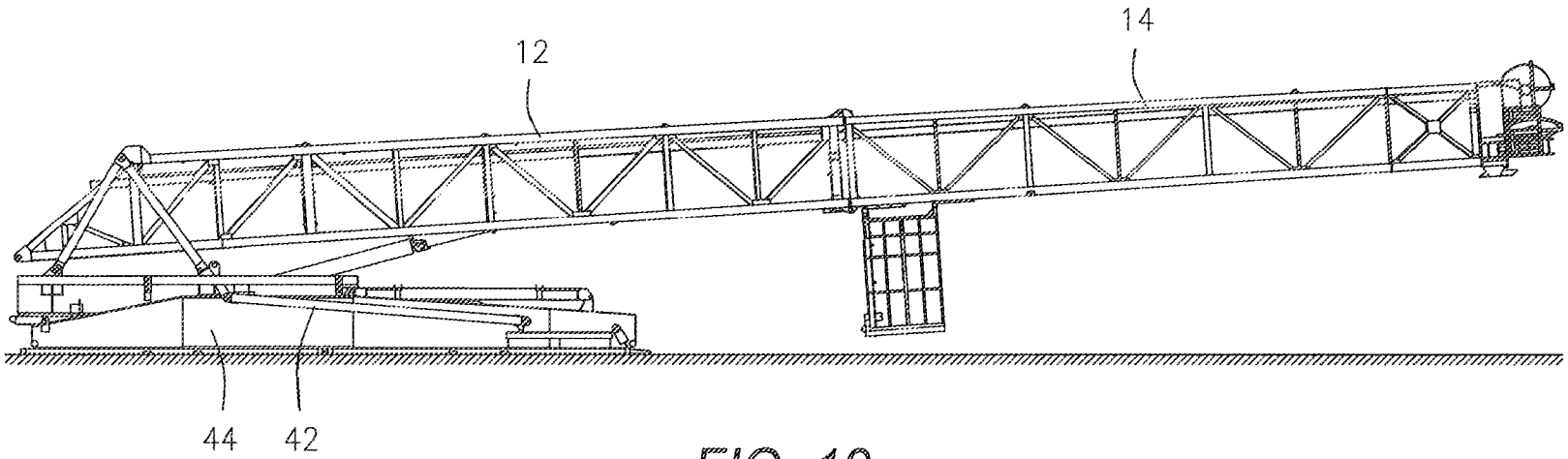

As best seen in FIG. 12, the upper mast section assembly 14 is thereafter brought to the site and connected to the top end of the lower mast section 12 by the dolly 90 and tractor trailer 92. Finally, as seen in FIG. 13, the dolly 90 and tractor trailer 92 are removed. Mast raising cylinders are connected to the lower mast section 12 in order to raise the lower mast section 12 and the upper mast assembly 14 to the upright, in use position.

In order to disassemble the mast apparatus for transportation to a new location, the reverse procedure is employed.

It will be appreciated that use of the present invention minimizes requirements of cranes and other lifting equipment.

Whereas, the present invention has been described in relation to the drawings attached hereto, it should be understood that other and further modifications, apart from those shown or suggested herein, may be made within the spirit and scope of this invention.

What is claimed is:

1. A folding mast apparatus having a back face and a pair of opposed sides with each of said opposed sides having a front leg and a back leg, which apparatus comprises:

at least one spreader beam assembly extending across said back face and connecting said back legs of said pair of opposed sides where each spreader beam assembly comprises two inner members and two outer channel members, where each of the two inner members extends between said back face and one of the two outer channel members with each of the two inner members pivotally connected to said back face and each of the two outer channel members extending between one of the two inner members and one said back leg such that, when in an open, use position, the two inner members are aligned with and lie in the same horizontal plane;

at least one pair of telescoping braces extending between said at least one spreader beam assembly and said back legs; and a pair of mast folding cylinders, each of said mast folding cylinders extending between one of said back legs and said back face in order to move said pair of opposed sides between an open, use position and a closed, transportation position.

2. A folding mast apparatus as set forth in claim 1 wherein said outer channel members are C-shaped and are receivable over said inner member.

3. A folding mast apparatus as set forth in claim 1 wherein each said at least one spreader beam assembly is pinned in place when in said open, use position.

4. A folding mast apparatus as set forth in claim 1 wherein said at least one spreader beam assembly includes a plurality of spreader beam assemblies parallel to each other.

5. A folding mast apparatus as set forth in claim 4 including at least one folding brace pivotally connected at one end to one said inner member and pivotally connected at an opposite end to another inner member.

6. A folding mast apparatus as set forth in claim 1 wherein said opposed sides are substantially parallel to each other in said closed, transportation system.

7. A folding mast apparatus as set forth in claim 1 including a traveling block and top drive which are pinned in place for transportation.

8. A folding mast apparatus as set forth in claim 1 including guide tracks on said back face.

9. A folding mast apparatus as set forth in claim 1 wherein said mast apparatus includes a hydraulic system and wherein said pair of mast folding cylinders are actuated by said hydraulic system.

10. A method of folding a mast apparatus having a back face and a pair of opposed sides with each of said opposed sides having a front leg and a back leg, which method comprises:

actuating a pair of mast folding cylinders wherein each of said mast folding cylinders extends between one said back leg and said back face;

retracting at least one spreader beam assembly extending across said back face and connecting said back legs of said opposed sides in response to said actuation of said pair of mast folding cylinders, where the spreader beam assembly comprises two inner members and two outer channel members, where each of the two inner members extends between said back face and one of the two outer channel members with each of the said inner members pivotally connected to said back face and each of the two outer channel members extends between one of the two inner members and one said back leg such that, when in an open, use position, the two inner members are aligned with and lie in a horizontal plane and the two outer channel members are aligned with and lie in the same horizontal plane; and retracting at least one pair of telescoping braces extending between said at least one spreader beam assembly and said back legs to move said pair of opposed sides toward each other from the open, use position to a closed, transportation position.

11. A method of folding a mast apparatus as set forth in claim 10 wherein said step of retracting said at least one spreader beam assembly includes pivoting the inner members of said spreader beam assembly with the outer channel members of said spreader beam assembly with the inner members pivotally connected to the outer channel members.

12. A method of folding a mast apparatus as set forth in claim 10 wherein said at least one spreader beam assembly includes a plurality of spreader beam assemblies parallel to each other.

13. A method of folding a mast apparatus as set forth in claim 12 including at least one folding brace pivotally connected at one end to one said inner member and pivotally connected at an opposite end to another inner member.

14. A method of folding a mast apparatus as set forth in claim 10 wherein said pair of opposed sides and said back face form a truncated pyramid in said open, use position.

15. A method of unfolding a mast apparatus having a back face and a pair of opposed sides with each of said opposed sides having a front leg and a back leg, which method comprises:

extending a pair of mast folding cylinders wherein each of said mast folding cylinders extends between one said back leg and said back face;

extending at least one spreader beam assembly which connects said back face and said back legs of said opposed sides, where the spreader beam assembly comprises two inner members and two outer channel members, where each of the two inner members extends between said back face and one of the two outer channel members with each of the said inner members pivotally connected to said back face and each of the two outer channel members extends between one of the two inner members and one said back leg such that, when in an open, use position, the two inner members are aligned with and lie in a horizontal plane and the two outer channel members are aligned with and lie in the same horizontal plane; and extending at least one pair of telescoping braces which connect said at least one spreader beam assembly and said back legs to move said pair of opposed sides away from each other from a closed, transportation position to the open, use position.

16. A method of unfolding a mast apparatus as set forth in claim 15 wherein said step of extending said at least one spreader beam assembly includes pivoting the inner members with the outer channel members of said spreader beam assembly with the inner members pivotally connected to the outer channel members.

17. A method of unfolding a mast apparatus as set forth in claim 15 wherein said at least one spreader beam assembly includes a plurality of spreader beam assemblies parallel to each other.

18. A method of unfolding a mast apparatus as set forth in claim 15 including at least one folding brace pivotally connected at one end to one said inner member and pivotally connected at an opposite end to another inner member.

19. A method of unfolding a mast apparatus as set forth in claim 15 wherein said pair of opposed sides and said back face form a truncated pyramid in said open, use position.

* * * * *